US005735249A

United States Patent [19]

Parke et al.

[11] Patent Number: 5,735,249

[45] Date of Patent: Apr. 7, 1998

[54] METHOD AND SYSTEM FOR CONTROLLING FUEL DELIVERY DURING ENGINE CRANKING

[75] Inventors: Alastair William Parke, Ann Arbor; Jeffrey Allen Doering, Canton, both of Mich.; Jon Dixon, Maldon, United Kingdom; Michael J. Cullen, Northville, Mich.; Paul Charles Mingo, Farmington Hills, Mich.; Robert Matthew Marzonie, Northville, Mich.

[73] Assignee: Ford Global Technologies, Inc., Dearborn, Mich.

[21] Appl. No.: 887,127

[22] Filed: Jul. 2, 1997

[51] Int. Cl.[6] ..... F02D 41/06

[52] U.S. Cl. ..... 123/491; 123/478

[58] Field of Search ..... 123/179.16, 478, 123/480, 491, 492, 493

[56] References Cited

U.S. PATENT DOCUMENTS

| | | | |
|---|---|---|---|
| 5,404,856 | 4/1995 | Servati | 123/478 |
| 5,408,972 | 4/1995 | Servati | 123/478 |
| 5,595,162 | 1/1997 | Iwai | 123/491 |
| 5,601,064 | 2/1997 | Fujimoto et al. | 123/491 |
| 5,634,449 | 6/1997 | Matsumoto et al. | 123/491 |
| 5,642,722 | 7/1997 | Schumacher et al. | 123/480 X |
| 5,647,324 | 7/1997 | Nakajima | 123/491 |

OTHER PUBLICATIONS

SAE Technical Paper No. 961188, "Model-Based Fuel Injection Control System For SI Engines", by Masahiro Nasu et al, May 6–8, 1996, pp. 85–95.

*Primary Examiner*—Tony M. Argenbright
*Attorney, Agent, or Firm*—Allan J. Lippa; Roger L. May

[57] ABSTRACT

A method and system for controlling fuel delivery to an individual cylinder of an internal combustion engine during engine cranking compensates for fuel transport dynamics and the actual fuel injected into the cylinder. A plurality of engine parameters are sensed, including engine temperature, inducted air mass per cylinder and number of engine intake events since cranking. A temperature of the engine stored at key-off is determined. A new puddle mass estimate for the cylinder is determined based on the decay ratio of the new puddle mass estimate to the prior puddle mass estimate stored before key-off utilizing the temperature of the engine stored at key-off. A desired fuel mass to be injected into the cylinder is then determined based on the new puddle mass estimate and the plurality of engine parameters.

17 Claims, 2 Drawing Sheets

METHOD AND SYSTEM FOR CONTROLLING FUEL DELIVERY DURING ENGINE CRANKING

CROSS-REFERENCE TO RELATED APPLICATIONS

This application is related to U.S. patent application Ser. No. 08/887,286 entitled "Method and System for Controlling Fuel Delivery During Transient Engine Conditions", which is assigned to the assignee and has the same filing date as the present application, which is hereby incorporated in its entirety.

TECHNICAL FIELD

This invention relates to methods and systems for controlling mass of fuel delivered to an individual cylinder during engine cranking.

BACKGROUND ART

Due to the ever-decreasing emission standards and improvements in catalyst performance, hydrocarbon (HC) emissions during engine start-up, or cranking (i.e., first five seconds) are approaching 50% of the total tailpipe emissions. Small reductions during start-up will therefore result in significant improvements in overall emissions.

In an effort to reduce emissions during engine start-up, many methods have been developed to more accurately control the amount of fuel delivered to an engine during start-up, or cranking, in order to maintain an air/fuel ratio that minimizes emissions. In controlling fuel mass injected into a cylinder, the engine control logic must monitor the amount of fuel injected into the cylinders. A portion of the mass of fuel that is delivered to a cylinder impinges on the intake surfaces and contributes to a puddle of fuel in the intake. The known prior art, however, fails to consider an accurate estimate of the puddle mass remaining in the cylinder's intake port at key-off in controlling the mass of fuel delivered to the cylinders at engine cranking.

Thus, there exists a need to improve air/fuel control during engine cranking by determining an accurate estimate of puddle mass on start-up taking into consideration various engine parameters.

DISCLOSURE OF THE INVENTION

It is thus a general object of the present invention to provide a method and system for determining the fuel mass to be delivered to an individual cylinder of an internal combustion engine during engine cranking based on an accurate estimate of the puddle mass remaining at each cylinder.

In carrying out the above object and other objects, features, and advantages of the present invention, a method is provided for determining the fuel mass to be delivered to a cylinder during engine cranking. The method includes the steps of sensing a plurality of engine parameters and determining a temperature of the engine stored at key-off. The method also includes the step of determining a new puddle mass estimate for the cylinder based on the temperature of the engine stored at key-off and a prior puddle mass estimate of the cylinder. Finally, the method includes the step of determining a desired fuel mass to be injected into the cylinder based on the new puddle mass estimate and the plurality of engine parameters.

In further carrying out the above object and other objects, features, and advantages of the present invention, a system is also provided for carrying out the steps of the above described method. The system includes a plurality of sensors for sensing a plurality of engine parameters. The system also includes control logic operative to determine a temperature of the engine stored at key-off, determine a new puddle mass estimate for the cylinder based on the temperature of the engine stored at key-off and a prior puddle mass estimate of the cylinder, and determine a desired fuel mass to be injected into the cylinder based on the new puddle mass estimate and the plurality of engine parameters.

The above object and other objects, features and advantages of the present invention are readily apparent from the following detailed description of the best mode for carrying out the invention when taken in connection with the accompanying drawings.

BEST MODES FOR CARRYING OUT THE INVENTION

Figure 1:
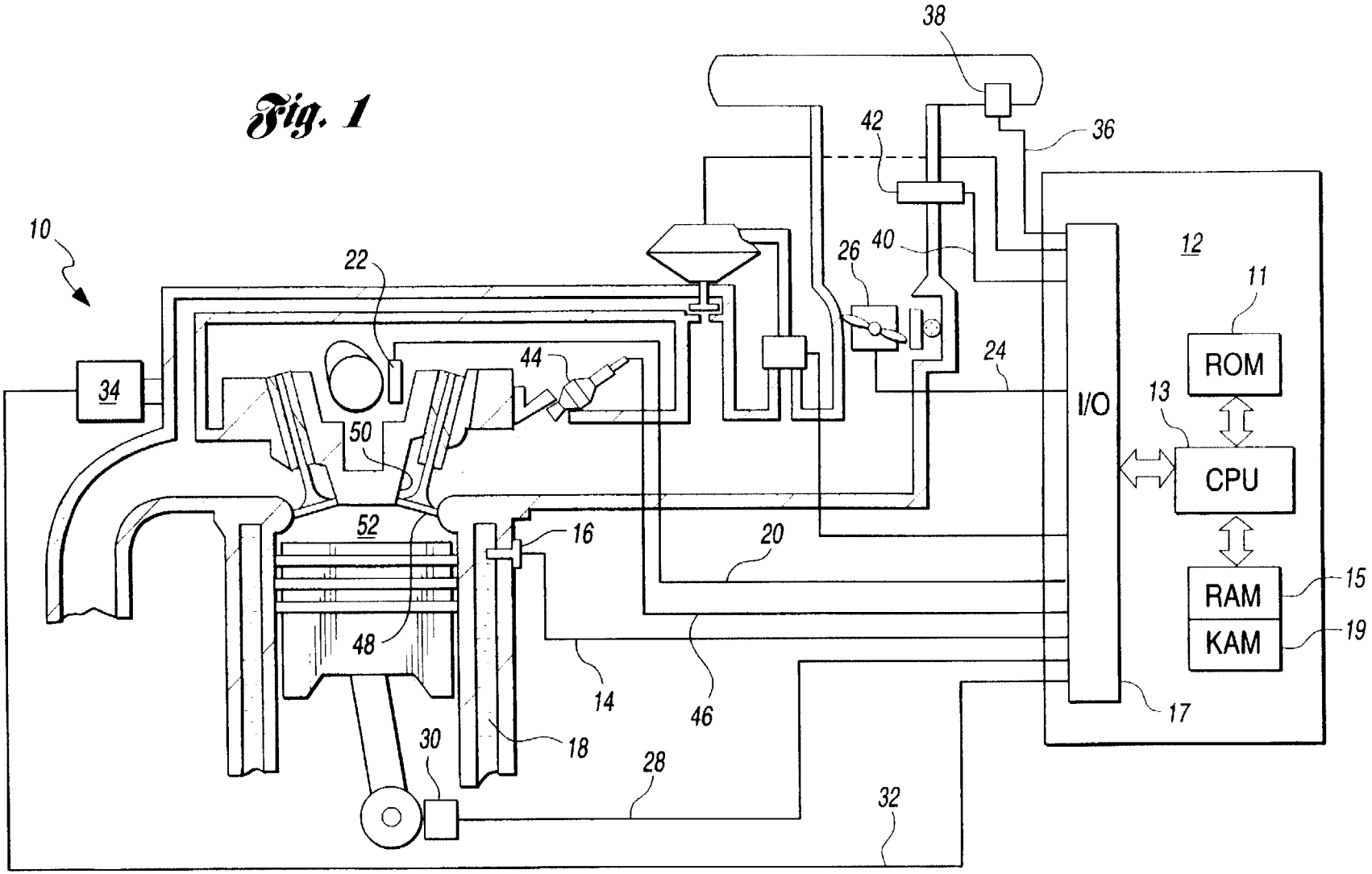
FIG. 1 is a schematic diagram of an internal combustion engine and an electronic engine controller which embody the principles of the present invention.

Turning now to FIG. 1, there is shown an internal combustion engine which incorporates the teachings of the present invention. The internal combustion engine 10 comprises a plurality of combustion chambers, or cylinders, one of which is shown in FIG. 1. The engine 10 is controlled by an Electronic Control Unit (ECU) 12 having a Read Only Memory (ROM) 11, a Central Processing Unit (CPU) 13, a Random Access Memory (RAM) 15, and a Keep Alive Memory (KAM) 19, a subset of RAM 15, which is separately powered so as to not lose its contents on power-off. The ECU 12 receives a plurality of signals from the engine 10 via an Input/Output (I/O) port 17, including, but not limited to, an Engine Coolant Temperature (ECT) signal 14 from an engine coolant temperature sensor 16 which is exposed to engine coolant circulating through coolant sleeve 18, a Cylinder identification (CID) signal 20 from a CID sensor 22, a throttle position signal 24 generated by a throttle position sensor 26, a Profile Ignition Pickup (PIP) signal 28 generated by a PIP sensor 30, a Heated Exhaust Gas Oxygen (HEGO) signal 32 from a HEGO sensor 34, an air intake temperature signal 36 from an air temperature sensor 38, and an air flow signal 40 from an air flow sensor 42. The ECU 12 processes these signals received from the engine and generates a fuel injector pulse waveform transmitted to the fuel injector 44 on signal line 46 to control the amount of fuel delivered by the fuel injector 44. Intake valve 48 operates to open and close intake port 50 to control the entry of an air/fuel mixture into combustion chamber 52.

Figure 2:
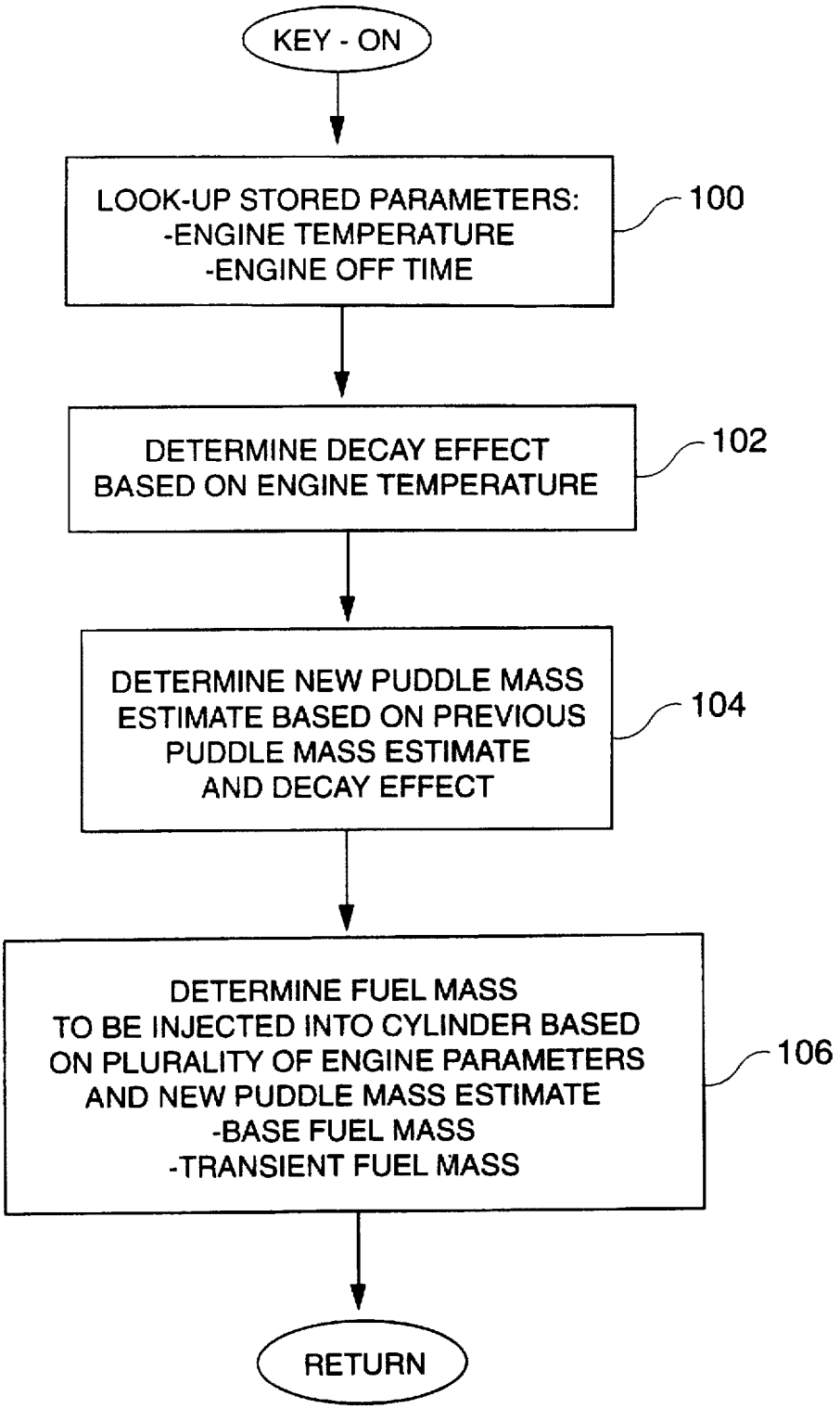
FIG. 2 is a flow diagram illustrating the general sequence of steps associated with the operation of the present invention.

Turning now to FIG. 2, there is shown a flow diagram illustrating a routine performed by a control logic, or the ECU 12. Although the steps shown in FIG. 2 are depicted sequentially, they can be implemented utilizing interrupt-driven programming strategies, object-oriented programming, or the like. In a preferred embodiment, the steps shown in FIG. 2 comprise a portion of a larger routine which performs other engine control functions.

Upon key-on, and power-up of the ECU 12, the method begins with looking up predetermined engine parameters that were stored in KAM 19, as shown at block 100. These parameters include engine temperature, as measured either by engine coolant temperature or cylinder head temperature, and engine off time, or soak time. Next, a puddle decay time constant is determined based on the engine temperature stored at key-off, as shown at block 102. The decay time constant is a calibratable function of engine temperature that is determined empirically.

The method proceeds to update the puddle mass for each cylinder based on the previously stored puddle mass and the decay time constant, as shown at block 104, according to the following:

$$m_p^k[i] = m_p^{k-1}[i] * e^{-(engine_off_time + 0.5min)/time\ constant} \quad (1)$$

where, $m_p^{k-1}[i]$ represents the puddle mass estimate stored at key-off;

engine_off_time corresponds to the amount of time the engine has been turned off, i.e., soak time; and time constant corresponds to the decay time constant determined at block 102.

The "engine_off_time" is incremented by one unit of resolution (currently 30 seconds) to guarantee a non-zero time measure and then divided by the decay time constant. This ratio is negated and used to calculate the exponential decay ratio of the new puddle mass to the puddle mass stored at key-off. Other suitable decay methods, such as linear models, piece-wise linear models, or other algebraic expressions, can be utilized instead of an exponential decay, if desired.

The desired injected fuel mass is then determined based on the updated puddle mass estimate, as shown at block 106. The desired injected fuel mass is calculated based on a base desired fuel mass and a transient fuel mass. The based desired fuel mass is determined according to the following:

$$m_{f_{base}}^k[i] = m_{f_{des}}^k[n] = cyl_air_chg \cdot f_a_ratio[n] - pcomp_lbm, \quad (2)$$

where cyl_air_chg is the current estimate of inducted air mass per cylinder according to air flow signal 40, f_a_ratio [n] is the desired in-cylinder fuel-air ratio for that cylinder's bank and pcomp_lbm is the estimate of fuel mass entering the cylinder from a conventional canister purge system (not shown). During cranking, the injected fuel mass is determined based on a desired inducted air/fuel ratio. If the throttle position signal 24 generated by a throttle position sensor 26 indicates that de-choke is desired, then the desired inducted f_a_ratio is set to zero, producing zero injector pulsewidths. Otherwise, $$f_a_ratio = \frac{f(crkpipctr_bg, ect)}{f(ect)} \quad (3)$$

where crkpipctr_bg counts how may PIP periods (or engine intake events) have past since cranking. The function in the denominator is the calculation of lambse for crank, modified by the multiplier in the numerator to allow calibration flexibility. Lambse represents a normalized air/fuel ratio.

The transient fuel mass is determined based on a discrete first-order X and τ model as follows:

$$m_{f_{trans}}^k[i] = \left[ \frac{X \cdot m_{f_{des}}^k[n] - m_p^{k-1}[i] \left( \frac{1}{\tau + 1} \right)}{1 - x} \right] \quad (4)$$

where X represents the fraction of fuel injected into the cylinder which will from a puddle in the intake port, 1−X is the remaining fuel, and τ represents a time constant describing the rate of decay of the puddle into the cylinder at each intake event. The discrete nature of the compensator reflects the event-based dynamics that occur in the engine cycle. The most logical input parameters to determine X and τ are:

$$\begin{aligned} X &= f_1(\text{manifold pressure, engine speed}) + \\ &\quad f_2(\text{engine temperature, time since start}) \\ \tau &= f_3(\text{engine temperature, time since start}), \end{aligned} \quad (5)$$

where "engine temperature" and "time since start" are existing inputs in the control system to describe the effective temperature governing the transient fuel dynamics, especially the temperature of the intake valve 48 and port walls of intake port 50. This temperature may be the output of a coolant or engine head temperature sensor. Regardless of what temperature is sensed, the dynamics are related to that temperature. While explicitly estimating a relevant temperature is possible, the time and temperature dependencies allow development flexibility that is useful for describing the differences in volatility between summer and winter blend fuels.

It is possible to calibrate combinations of X and τ that produce an unstable compensator. To keep the compensator's pole inside the unit circle in the z-plane, the stability criteria for X is:

$$X < \frac{2\tau + 1}{2\tau + 2} \quad (6)$$

For robustness, X is clipped to this threshold minus a safety factor before any fuel calculations are performed:

$$X_{final} = \min\left( X, \frac{2\tau + 1}{2\tau + 2} - \Delta X_{safety} \right) \quad (7)$$

The injected fuel mass is then calculated at as:

$$m_{f_{inj}}^k[i] = m_{f_{des}}^k[n] + m_{f_{trans}}^k[i] \quad (8)$$

with $m_{f_{inj}}^k[i]$ still being subject to the constraints on injection pulsewidths, such as, minimum injector pulsewidths, interrupt scheduling limitations, closed-valve injection timing, etc.

After the injector pulsewidth for cylinder i has been scheduled, its pulsewidth will be updated as necessary/possible based on changes in $m_{f_{des}}^k[n]$. If cylinder i's injection off-edge has not been delivered after a new $m_{f_{des}}^k[n]$ is calculated, a determination is made to see if the desired in-cylinder fuel mass has changed significantly.

$$\text{If } |m_{f_{des}}^k[n] - m_{f_{base}}^k[i]| > \text{some threshold} \quad (9)$$

=> update injector pulsewidth

If the injector pulsewidth for cylinder i should be updated, the base fuel required is updated, including the same transient fuel compensation equations described above, to calculate a delta change in the injected fuel mass for cylinder i:

$$\Delta m_{f_{trans}}^k[i] = \frac{x \cdot (m_{f_{des}}^k[n] - m_{f_{base}}^k[i])}{1 - X} \quad (10)$$

$$m_{f_{base}}^k[i] = m_{f_{des}}^k[n].$$

The updated fuel mass is then delivered to the fuel injector 44.

Any lean error in what has been delivered can still be corrected with a dynamic fuel pulse during the open-valve intake event. Under some circumstances, the injector pulsewidth can be updated more than once, and the above procedure is repeated.

If cylinder i is on its intake stroke, there is one last chance to fuel additionally if $m_{f_{des}}{}^{k}[n]$ is larger than the desired in-cylinder fuel that has been accounted for to this point, $m_{f_{base}}{}^{k}[i]$. The additional fuel required is compared with the minimum amount of in-cylinder fuel the dynamic pulse can account for (including transient fuel dynamics):

$$\text{If}(m_{f_{des}}{}^{k}[n]-m_{f_{base}}{}^{k}[i])>\text{min injection mass}\cdot(1-X_d)\rightarrow\text{perform dynamic pulse} \quad (11)$$

If a dynamic pulse can be issued for cylinder i, transient fuel compensation is included to calculate an injected dynamic fuel mass for cylinder i, using an open-valve dynamic value, $X_d$, as follows:

$$m_{f_{dyn}}^{k}[i]=\frac{(m_{f_{des}}^{k}[n]-m_{f_{base}}^{k}[i])}{1-X_d} \quad (12)$$

where $X_d$ is an estimate of the open-valve injected mass fraction that does not enter the cylinder during this event.

After the injector's main pulse, and any dynamic pulse have been delivered, the puddle mass estimate is updated to reflect the desired system behavior and any system constraints, as shown below.

$$m_p{}^{k}[i]=\frac{m_p^{k-1}[i]\cdot\tau}{1+\tau}+X\cdot m_{f_{inj}}^{k}[i]+X_d\cdot m_{f_{dyn}}^{k}[i] \quad (13)$$

The puddle mass estimates must be stored in KAM 19 for retrieval and use on engine start-up.

While the best modes for carrying out the invention have been described in detail, those familiar with the art to which this invention relates will recognize various alternative designs and embodiments for practicing the invention as defined by the following claims.

What is claimed is:

1. A method for determining an amount of fuel to be delivered to an individual cylinder of an internal combustion engine during engine cranking, the individual cylinder having an intake port for regulating entry of the fuel into the cylinder and having a prior puddle mass estimate corresponding to a mass of fuel previously remaining in the intake port before key-off of the engine, the method comprising:

sensing a plurality of engine parameters;

determining a temperature of the engine stored at key-off;

determining a new puddle mass estimate for the cylinder based on the temperature of the engine stored at key-off and the prior puddle mass estimate; and determining a desired fuel mass to be injected into the cylinder based on the new puddle mass estimate and the plurality of engine parameters.

2. The method as recited in claim 1 further comprising controlling the fuel mass delivered to the cylinder based on the desired fuel mass.

3. The method as recited in claim 1 wherein determining the new puddle mass estimate includes determining a decay effect based on the engine temperature.

4. The method as recited in claim 3 wherein determining a decay effect includes determining an exponential decay.

5. The method as recited in claim 4 wherein determining the exponential decay includes determining an amount of time that has elapsed since key-off.

6. The method as recited in claim 1 wherein determining the desired fuel mass includes determining a base fuel mass and a transient fuel mass.

7. The method as recited in claim 6 wherein determining the base fuel mass includes determining a desired in-cylinder air/fuel ratio.

8. The method as recited in claim 7 wherein determining the desired in-cylinder air/fuel ratio includes determining a number of engine intake events since cranking.

9. A system for determining an amount of fuel to be delivered to an individual cylinder of an internal combustion engine during engine cranking, the individual cylinder having an intake port for regulating entry of the fuel into the cylinder and having a prior puddle mass estimate corresponding to a mass of fuel previously remaining in the intake port before key-off of the engine, the system comprising:

a plurality of sensors for sensing a plurality of engine parameters; and control logic operative to determine a temperature of the engine stored at key-off, determine a new puddle mass estimate for the cylinder based on the temperature of the engine stored at key-off and the prior puddle mass estimate, and determining a desired fuel mass to be injected into the cylinder based on the new puddle mass estimate and the plurality of engine parameters.

10. The system as recited in claim 9 wherein the control logic is further operative to control the fuel mass delivered to the cylinder based on the desired fuel mass.

11. The system as recited in claim 10 wherein the control logic, in determining the new puddle mass estimate, is further operative to determine a decay effect based on the engine temperature.

12. The system as recited in claim 11 wherein the control logic, in determining the decay effect, is further operative to determine an exponential decay.

13. The system as recited in claim 12 wherein the control logic, in determining the exponential decay, is further operative to determine an amount of time that has elapsed since key-off.

14. The system as recited in claim 9 wherein the control logic, in determining the desired fuel mass, is further operative to determine a base fuel mass and a transient fuel mass.

15. The system as recited in claim 14 wherein the control logic, in determining the base fuel mass, is further operative to determine a desired in-cylinder air/fuel ratio.

16. The system as recited in claim 15 wherein the control logic, in determining the desired in-cylinder air/fuel ratio, is further operative to determine a number of engine intake events since cranking.

17. An article of manufacture for an internal combustion engine of an automotive engine having an individual cylinder having an intake port for regulating entry of the fuel into the cylinder and having a prior puddle mass estimate corresponding to a mass of fuel previously remaining in the intake port before key-off of the engine and the vehicle further having a plurality of sensors for sensing a plurality of engine parameters comprising:

a computer storage medium having a computer program encoded therein for determining a temperature of the engine stored at key-off, determining a new puddle mass estimate for the cylinder based on the temperature of the engine stored at key-off and the prior puddle mass estimate, and determining a desired fuel mass to be injected into the cylinder based on the new puddle mass estimate and the plurality of engine parameters.

* * * * *